US006602093B1

(12) United States Patent
Cannon

(10) Patent No.: US 6,602,093 B1
(45) Date of Patent: Aug. 5, 2003

(54) PRECISION BNC CONNECTOR

(75) Inventor: James Edward Cannon, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/225,890

(22) Filed: Aug. 22, 2002

Related U.S. Application Data

(62) Division of application No. 10/136,120, filed on Apr. 30, 2002.

(51) Int. Cl.[7] ..... H01R 9/05
(52) U.S. Cl. ..... 439/578
(58) Field of Search ..... 439/578–585

(56) References Cited

U.S. PATENT DOCUMENTS 2,844,644 A * 7/1958 Soule, Jr.
3,678,445 A * 7/1972 Brancaleone
4,106,839 A * 8/1978 Cooper
4,423,919 A * 1/1984 Hillis
4,426,127 A * 1/1984 Kubota
5,898,993 A * 5/1999 Inaba et al.
6,332,815 B1 * 12/2001 Bruce ..... 439/578

* cited by examiner

*Primary Examiner*—Gary Paumen
(74) *Attorney, Agent, or Firm*—Edward L. Miller

(57) ABSTRACT

A solution to problems of poor RF performance in conventional BNC connectors is to first, eliminate the use of Teflon, in favor of an air dielectric in the vicinity of the mating parts, and support the male and female center pins further back within the body of the connector, using other proven dielectric materials borrowed from the precision type N connector, or from another 7 mm RF connector. Next, a captive knurled draw nut provides positive displacement and the tension needed to draw the already mated male and female connector halves together, in place of the conventional spring tension. It is the bottoming out of the male shell inside the female shell that resists the positive displacement and the tension supplied by the knurled draw nut, ensuring that the two connector halves are actually in contact, and that the edges of shell surfaces that need to "vanish" for good operation do indeed vanish. The mating center conductors are rigidly mounted within their shells and bottom out against each other at the same time as do the shells. The basic bayonet latch mechanism is retained, so that either half of the new connector will mate with opposite sex halves of conventional BNC connectors.

4 Claims, 6 Drawing Sheets

PRECISION BNC CONNECTOR

REFERENCE TO RELATED PATENT

This case is a division of Ser. No. 10/136,120 entitled Precision BNC Connector, filed on Apr. 30, 2002 by James E. Cannon, assigned to Agilent Technologies, Inc.

BACKGROUND OF THE INVENTION

The venerable BNC connector is used in a great many instruments for a variety of purposes, ranging from connecting probes on equipment that uses probes (e.g., oscilloscopes) to general input and output of signals. It comes in various grades, ranging from the more expensive instrument grade clamp type to crimp on versions that are not expected to exhibit the full measure of performance or long term durability that is associated with the silver plated mil-spec top of the line versions. Aside from the variety of versions to choose from, one of the positive aspects of BNC is its ease of use. It is pushed on and then mated with a simple quarter-turn twist. This aspect of BNC compares favorably with other series connectors, such as TNC, N, SMA, APC-7 and APC-3.5, each of which involves a threaded nut or sleeve that must be given several turns to mate the connector.

BNC connectors are readily available, relatively inexpensive (as RF connectors go) and all the various versions (as long as the characteristic impedance is the same) inter-mate with one another. It is truly a workhorse of the electronics industry.

Despite its popularity, the BNC connector has some significant drawbacks when used as an instrument grade connector for some electronic test equipment, such as top of the line high frequency oscilloscopes. It has reactive discontinuities at high frequencies. That is, above certain frequencies it fails to match the 50Ω characteristic impedance of the coaxial transmission line of which it is expected to be a part. Even the most carefully installed mil-spec clamp type BNC connector is extremely visible as a discontinuity on a TDR (Time Domain Reflectometer) of even modest bandwidth. Next, it tends to "leak" (radiate from its mating surfaces) above, say, 500 MHZ. Finally, since it relies solely on internally supplied spring tension to draw its parts together, it can, when under externally applied tension, allow the mating parts to separate sufficiently to degrade the quality of the connection (greater discontinuity, more loss), sometimes to point where the connection is interrupted altogether (especially if the parts are worn from extended use).

Much (although not all) of the problems of BNC connectors can be traced to aspects in the design of the male half, which is to say, the part that has the male center conductor pin and that is given the quarter turn twist while gripping a knurled shell we shall call a bayonet latch. Let us briefly take a closer look at the conventional BNC connector, the better to appreciate why it has these problems.

To begin, refer to FIG. 1, which is a side view 1 of a pair of mating BNC connector halves 2 and 3. Connector half 2 is the female part (going by the pin for the center conductor, which is not visible), while connector half 3 is the male part. From the drawing we cannot tell what overall function the female part 2 performs; it might be part of a "tee," the BNC part of a cross series adapter, be cable mounted or bulkhead mounted; such differences do not matter, the portion that is shown would be the same in all those cases. The male part is depicted as being a clamp-type cable mount part, and that, too, is simply one choice among many. Thus, a rear portion of a male shell 10 of the clamp variety is visible, as is the cable 11 it attaches to.

The female part 2 has a reduced diameter section 5 over which the male part slides. During this action the male center pin enters the female center pin (which is not visible in this view) while spiral grooves 7 engage pins 6 for the quarter turn (another groove 7 and pin 6 are on the back side of the part shown). A detent 8 in the spiral groove 7 engages the pin 6, preventing spontaneous disengagement by requiring that some twisting force be applied to the connector to overcome the action of the detent. A spring action to be described below cooperates with the detent and pin 6 in producing this behavior. A knurled ring on bayonet latch 9 assists in performing the quarter turns needed for mating and un-mating the connector halves.

Refer now to FIG. 2, which is an exploded view of the BNC connector halves of FIG. 2. While bearing in mind that BNC connectors are fabricated in different ways according to manufacturer's preference, we can nevertheless appreciate the basic mechanisms that account for certain of the BNC connector's troubles that we set out above.

Note that the female connector portion 2 includes a female center pin 13 that is centered and held in place by a Teflon sleeve 15. The sleeve 15 has a stepped diameter in front that engages a corresponding shoulder in a female shell (4, 5). The sleeve 15 is secured in place from the rear, either by a rolled edge with or without a washer, or, as is shown, by a clamp nut 14. (In this figure we have chosen to let connector half 2 be a bulkhead mounted clamped-to-cable assembly, which is merely exemplary.) Teflon sleeve 15 has a reduced diameter portion 22 that will be of interest, shortly.

Now consider the male connector half 3. As an assembly it includes a Teflon sleeve 20 whose rear portion has a small diameter bore that centers and supports a male center pin 19, and whose front portion has a larger diameter bore 23 sized to just slip over the reduced diameter portion 22 of sleeve 15.

Another aspect of male connector half 3 that is of interest are the washers 16 and 18, between which are located spring washer(s) 17. When assembled, the knurled male BNC bayonet latch 9 is made captive to male BNC shell 21. BNC shell 21 has a collection of slits that make somewhat springy the end that enters the female shell 5.

Here is how BNC shell 21 is made captive to the bayonet latch 9. Washer 18 centers itself on and is retained by, a shoulder 24 of the male shell 21 (or the washer 18 is split, so that it may snap into a groove 24), while the outside of washer 16 centers itself within a cavity in the back of the bayonet latch 9, as its inside slides over the outer diameter of male shell 21. A rolling of an edge in the back side of bayonet latch 9 makes washer 16 captive within the cavity. Furthermore, bayonet latch 9 cannot slide off the male shell toward the rear, owing to a stepped shoulder 24. Between the two washers 16 and 18 are one or more spring washers 17 that push washers 16 and 18 apart. What they also do is push the bayonet latch 9 rearward in the direction of arrow 25 when the connector halves are mated. This is the internally supplied spring tension that keeps detent 8 engaged against pin 6, and requires torque to overcome in order to unlatch the connector. Unfortunately, pulling on the cable 11 (see FIG. 1) in the direction of arrow 25, or otherwise inducing external tension urging the two connector halves apart, can overcome the internal spring tension (from spring washers 17) keeping the connectors halves together. A sufficient tension will compresses the springy washers 17 as they yield, and the connector halves draw apart slightly.

There are two basic aspects that we wish to point out. First, the tapered end of the male center pin 19 enters a slit end of female pin 13, and ordinarily spreads those slit portions apart slightly, for good contact. As the connector wears the resilience in the slit female pin is reduced, so that a slight withdrawal of the male pin can decrease the ohmic quality of the connection. Equally as bad at higher frequencies, as the withdrawal occurs, there appears a short length over which there is a decrease in diameter. (That is, the male and female center pins have the same outer diameter, and when they are fully mated there are annular surfaces that touch, shoulder to shoulder. When that occurs there is no, or very little, effective change in the outer diameter of the combined center pins.) A similar increase in the effective diameter of the outer conductor occurs also, as the end of the male shell pulls away from the shoulder in the female shell that it seats upon. These changes are important, since the characteristic impedance of a coaxial transmission line involves the ratio of the outer diameter of the center conductor and the inner diameter of the outer conductor, as moderated by the dielectric constant therebetween. When the male center pin 19 withdraws slightly from the female pin 13, a short length of diameter reduction occurs at the same location as a short length of outer diameter increase occurs, and this "double whammy" appears as a very definite discontinuity.

A similar bad thing happens in connection with the Teflon sleeves 15 and 20. Ordinarily, the reduced diameter section 22 of sleeve 15 would be the exact complement of the large diameter portion 23 of sleeve 20. The idea is that when they mate their edges vanish, as it were, and the two parts act as a single part of continuously present material of the proper diameter. (The joining of the center conductor pins is supposed to use this same idea.) That fails when the connector halves pull apart, producing a discontinuity owing to a location of altered dielectric constant. Furthermore, the presence of the Teflon is a bit of a problem in the first place, since it is difficult to machine the stuff to the tolerances needed to reliably perform the magic of the vanishing edges. Also, it is the Teflon that is supposed to hold the center conductor pins in their proper locations, but it can't hold tight tolerances. Especially since Teflon cold flows so easily; even a brand new, but especially a used connector, will have Teflon sleeves 15 and 20 that exhibit and account for significant mating anomalies.

It would be desirable if there were a precision BNC connector whose male and female portions would inter-mate with their conventional counter-parts and perform satisfactorily, but that when mated with themselves gave truly superior performance, right up to 18 GHz, comparable to the best precision type N connectors. Ah, but how to do it?

SUMMARY OF THE INVENTION

A solution to the problem of poor RF performance in the conventional BNC connector is to first, eliminate the use of Teflon, in favor of an air dielectric in the vicinity of the mating parts, and support the male and female center pins further back within the body of the connector, using other proven dielectric materials borrowed from the precision type N connector, or from another 7 mm RF connector. Next, a captive knurled draw nut provides positive displacement and the tension needed to draw the already mated male and female connector halves together, in place of the conventional spring tension. It is the bottoming out of the male shell inside the female shell that resists the positive displacement and the tension supplied by the knurled draw nut, ensuring that the two connector halves are actually in contact, and that the edges of surfaces that need to "vanish" for good operation do indeed vanish. The mating center conductors are rigidly mounted within their shells and bottom out against each other at the same time as do the shells. The basic bayonet latch mechanism is retained, so that either half of the new connector will mate with opposite sex halves of conventional BNC connectors.

DESCRIPTION OF A PREFERRED EMBODIMENT

Figure 1:
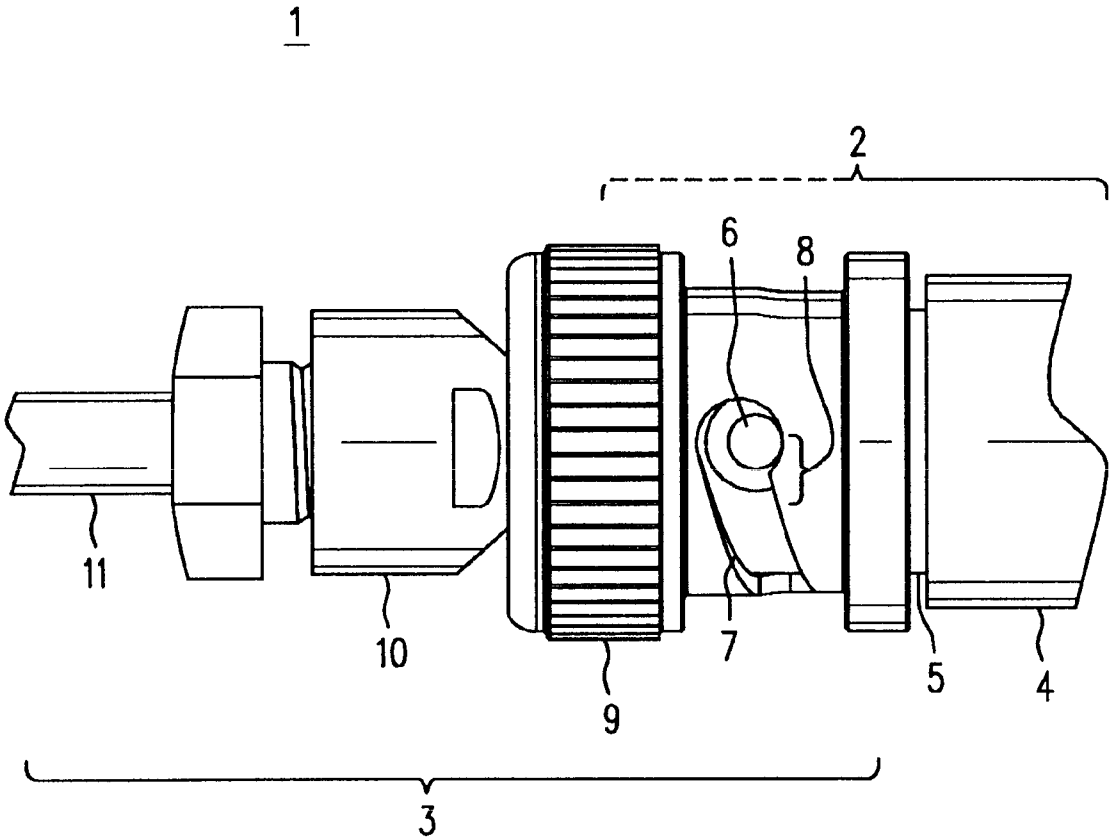
FIG. 1 (PRIOR ART)
FIG. 1 is a side view of a mated pair of prior art BNC male and female connector halves.
Figure 2:
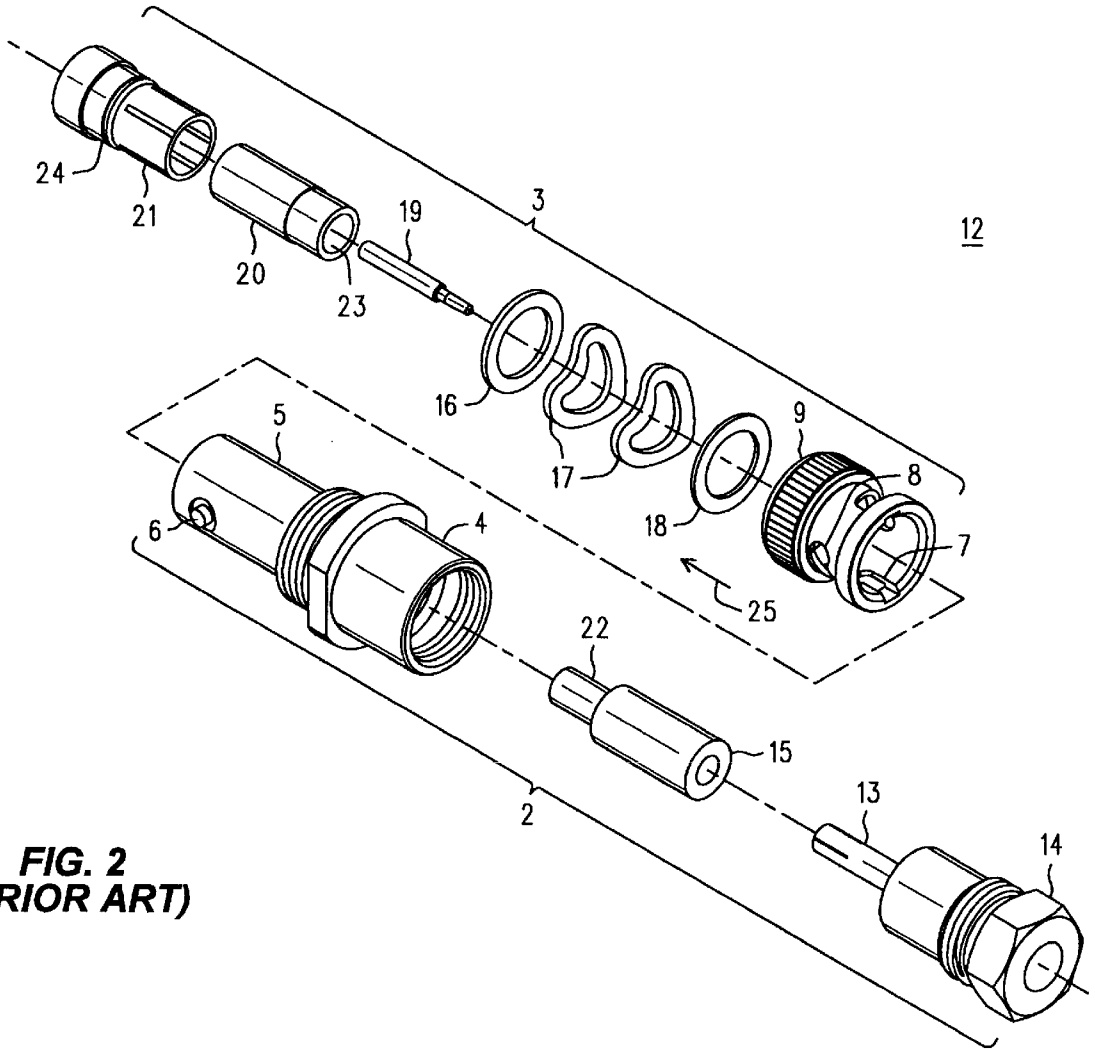
FIG. 2 (PRIOR ART)
FIG. 2 is a exploded view of the prior art BNC connector halves of FIG. 1.
Figure 3:
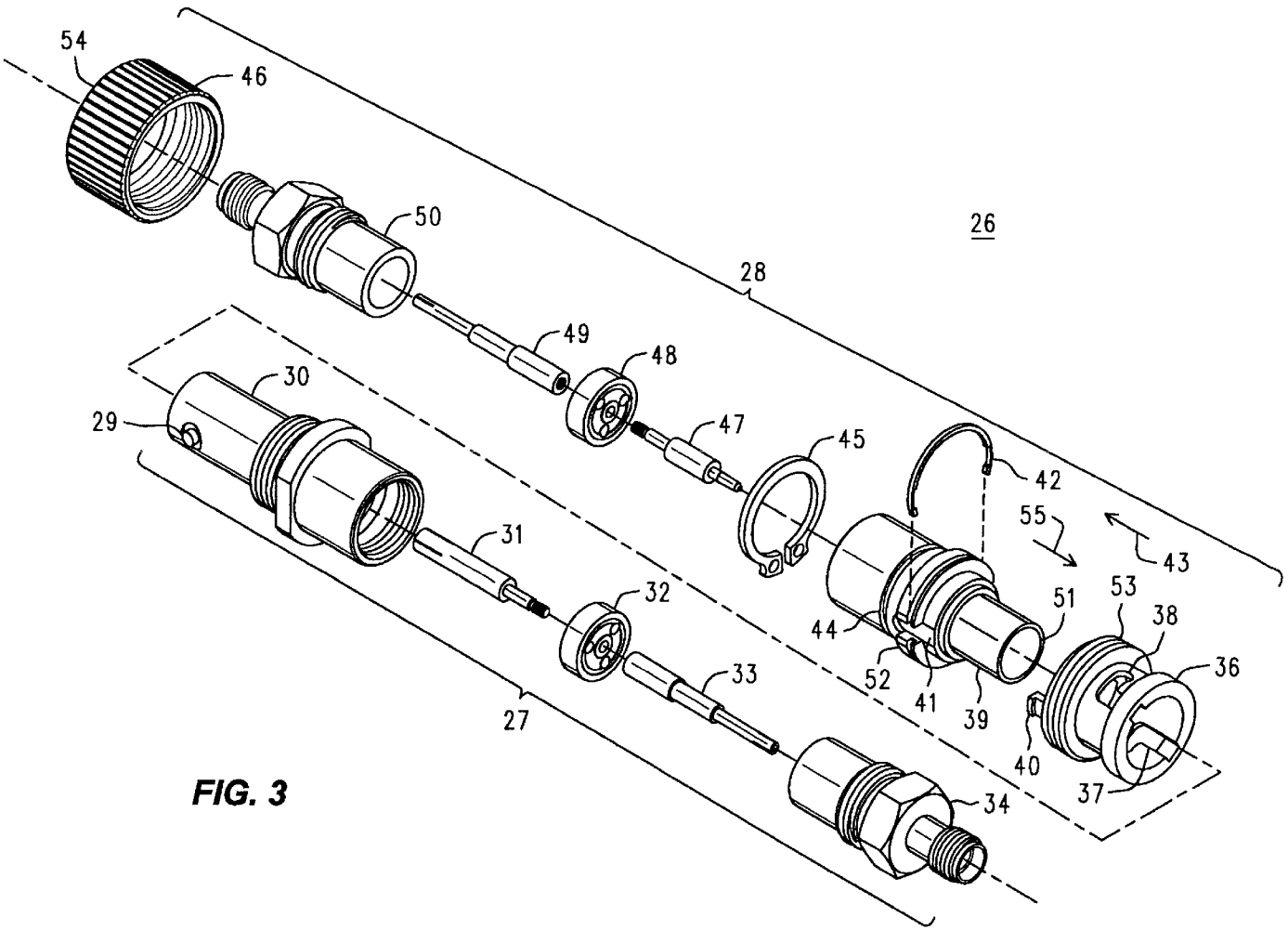
FIG. 3 is an exploded view of a precision BNC connector male and female halves constructed in accordance with the invention.

Refer now to FIG. 3, wherein is shown an exploded view 36 of a precision BNC connector having a female portion 27 and a male portion 28. Let us begin with the female portion, as it is the simplest and most closely resembles its conventional female BNC counterpart. It is a bulkhead mounted part that serves as a precision BNC to APC 3.5 cross series adapter, and it will be readily appreciated that other overall configurations (e.g., cable mounted) fall within the scope of the invention. Female portion 27 includes a female shell 30 having the usual bayonet pins 29. Note female center pin 31 and center conductor 33. They screw together after a reduced diameter section on pin 31 passes through a 7 mm center conductor support bead 32. The support bead 32 fits snugly against a shoulder within female shell 30, and is held in place by an APC 3.5 female shell 34, which threads into back of the BNC female shell 30.

There are several things to note at this point. First, the 7 mm center conductor support bead, the center conductor 33 and APC 3.5 female shell 34 are conventional parts already used in other connectors or cross series adapters. The BNC female pin 31 is mounted in the same manner as occurs for the precision type N connector, although this one is sized for BNC. The BNC female shell 30 is preferably made of a stainless steel alloy (such as for example, type 303 ATSM A582 condition "A"), rather than of plated brass. Note the absence of any Teflon parts in the female portion 27. Save for the 7 mm center conductor support bead 32, this is an air dielectric connector.

Now consider the male portion 28. It includes a threaded bayonet latch 36 having a spiral groove 37, similar to the conventional male BNC connector. The interior terminus of the spiral groove also includes a detent 38, also similar in shape and in ultimate function, as is found in the conventional male BNC connector.

Notice male shell 39, whose rearward end is a hollow cylinder, over which the bayonet latch 36 slides. After the fashion in the precision type N connector, the shell 39 does not have slits as does the conventional BNC male shell, but remains an un-slit cylinder. As the bayonet latch 36 slides over the male shell 39, a pair of dogs, or catches, 40 slide in slots 41. (There is a dog and a slot on each side, and only one pair is visible.) Once the latch 36 and shell 39 have slid together, a C-ring 42 can be installed into a groove in the body of shell 39. What this does is allow bayonet latch 36 to slide back and forth by a small amount sufficient to provide for the displacement needed by the spiral groove 37 to defeat the detent 38 during mating, but that otherwise keeps the bayonet latch 36 captive upon the male shell 39. This occurs because the outward hook in the dog 40 interferes with the C-ring 42, while the rest of the dog, sliding in the confines of the recess 41, passes beneath the C-ring.

At this point it is clear how part of this connector works. Male shell 39 will enter the inside end of female shell 30. The annular end 51 of male shell 39 will bottom out on a shelf inside female shell 30, providing good outer conductor connection (the vanishing joint trick), provided that suitable compression can be applied. Likewise, a male center pin 47 will penetrate female center pin 31 by a predetermined amount, if it is arranged that it is carried in the male shell 39 in a proper location. Here is how that is done, and note that once again, no Teflon is used.

Once again, we borrow the existing 7 mm center conductor support bead. It appears as item 48 in the figure, and it is a second instance of the item 32. Just as with the female BNC half 27, male center conductor pin 47 has a reduced diameter section that passes through support bead 48 and, via threads, engages (in this case) another female APC 3.5 center conductor 49 (which may be the same part as 33). Another APC 3.5 female shell 50 threads into the rear of the male shell 39 and holds support bead (and the center conductor pins 47 and 49, too) seated against a shouldered recess within the male shell 39. It will also be appreciated that the male BNC connector half 28 might be another style of connector, beside the BNC to APC 3.5 cross series adapter that is shown. It could be a clamp type cable mounted connector, for example, or adapt to another series, such as type N.

So now all the center conductors are axially in place, and the bayonet latch 36 can engage the bayonet pins 29, the center conductor pins 47 and 31 will engage, and the BNC male shell 39 will enter the BNC female shell 30. The usual forward motion accompanied by a quarter turn twist is performed to bring bayonet pins 29 up the spiral groove 37 and into the vicinity of detent 38. What is needed now is something to take the place of the spring and keep the bayonet mechanism properly engaged, using detent 38.

Now consider knurled draw nut 46. Observe that is has internal threads. Note also that bayonet latch 36 has external threads 53. Knurled draw nut 46 threads onto threads 53. The back side 54 of the draw nut has a reduced diameter hole that bottoms out against shoulder 52. It will be appreciated that once that happens (the bottoming out) further rotation in the same direction (producing more thread engagement) draws bayonet latch 36 toward male shell 39 in the direction of arrow 43. We will come back to the effect of that directly, but first let's get the knurled draw nut 46 captive, so that things do not come apart. It is made captive by snap ring 45, which is applied after the draw nut is in position. Snap ring engages groove 44, and remains in place until removed. It allows the knurled draw nut 46 to be rotated by the thumb and forefingers, but prevents it from traversing back and forth by more than just a small amount.

Thus it is that when the operator applies CW (viewed from behind) rotation to the knurled draw nut he is tightening the connector by causing the latch 36 to move in the direction of arrow 43 over the outer portion of male shell 39. But pins 29 are (by supposition) engaged in the detents 38. This causes male shell 39 to be pushed into female shell 30, along the direction of arrow 55. That continues until annular surface 51 bottoms out inside the female shell 30. At that point, as soon as any remaining slack is drawn out by a slight further twisting of the draw nut, the connector is tight, and cannot even be wiggled side to side. This is very good for the RF connection, since: (1) the annular surface 51 bottoms out; and (2) center conductor pins 47 and 31 achieve shoulder-to-shoulder contact at their maximum diameters (the vanishing edge trick) all at the same time. They are then rigidly held in that condition, under significant compression.

To undo the connector, one gives the knurled draw nut 46 a quarter CCW turn, and then undoes the bayonet latch, with its quarter turn twist, in the usual manner.

It will be appreciated the precision BNC connector halves 27 and 28 each mate with standard BNC connectors of the opposite sex. That is because the geometry of the bayonet mechanism is the same, as are all the inner and outer diameters forming the coaxial transmission line that the connector attempts to mimic. The absence of the Teflon does not produce interference, nor is there a problem with non-slit shells (precision type N has the same issues with non-precision type N parts). One cannot expect superior electrical performance from the cross combination, but it "works," which would be a significant wart if it didn't, and would mean that it could not fairly be called a BNC connector.

Figure 4:
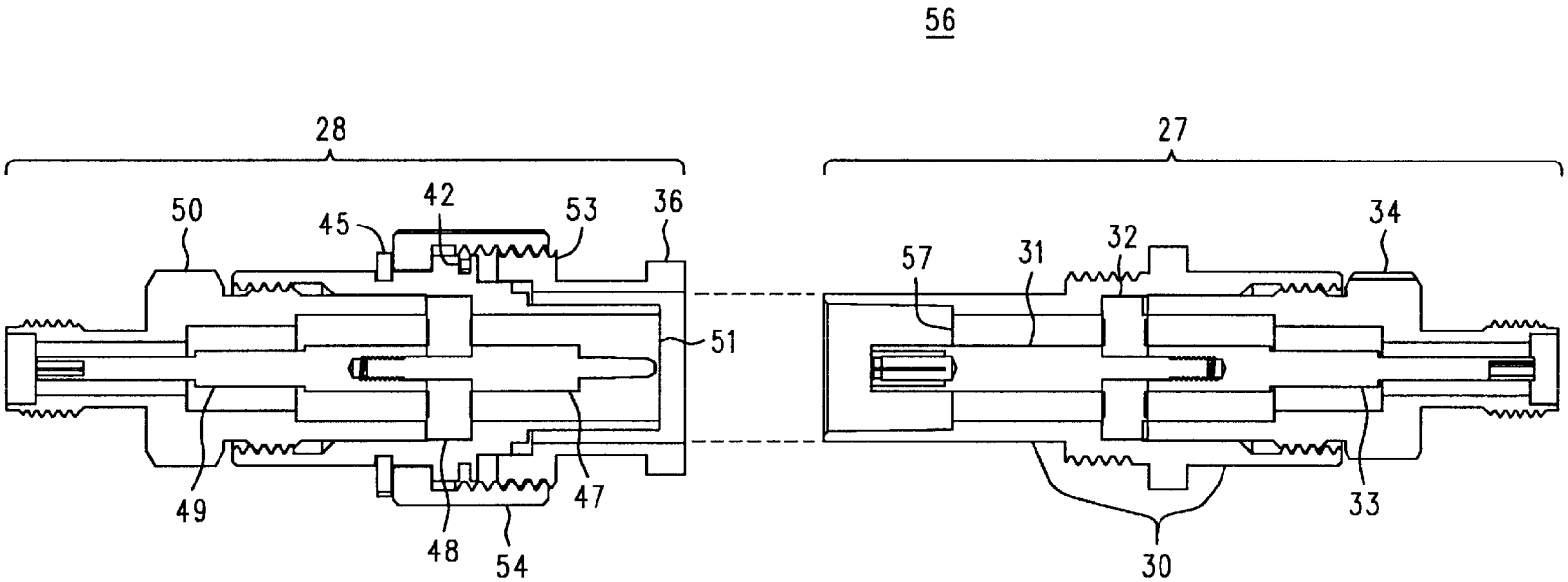
FIG. 4 is a cut-away side view of an un-mated pair of the precision BNC male and female connector halves of FIG. 3.

Refer now to FIG. 4, which is a cross sectional view 56 of the un-mated male and female precision BNC connector halves, 28 and 27. In this and the following figures, like items have the same reference characters. The figure is useful, for example, in seeing how the 7 mm center conductor support beads 48 and 32 support their center conductors, and how the respective beads are neatly removably affixed within the body of their associated connector half. This is fairly important, as connector center pins do sometimes get ruined (mated it with a damaged other half, or with a part that has a larger sized center conductor for a different $Z_0$ . . . ) and must be replaced.

An additional aspect is easily visible in FIG. 4. Note the locations of annular surface 51 and the surface 57, inside the female shell 27, against which annular surface 51 will bottom out when the connector halves are mated and then tightened.

Figure 5:
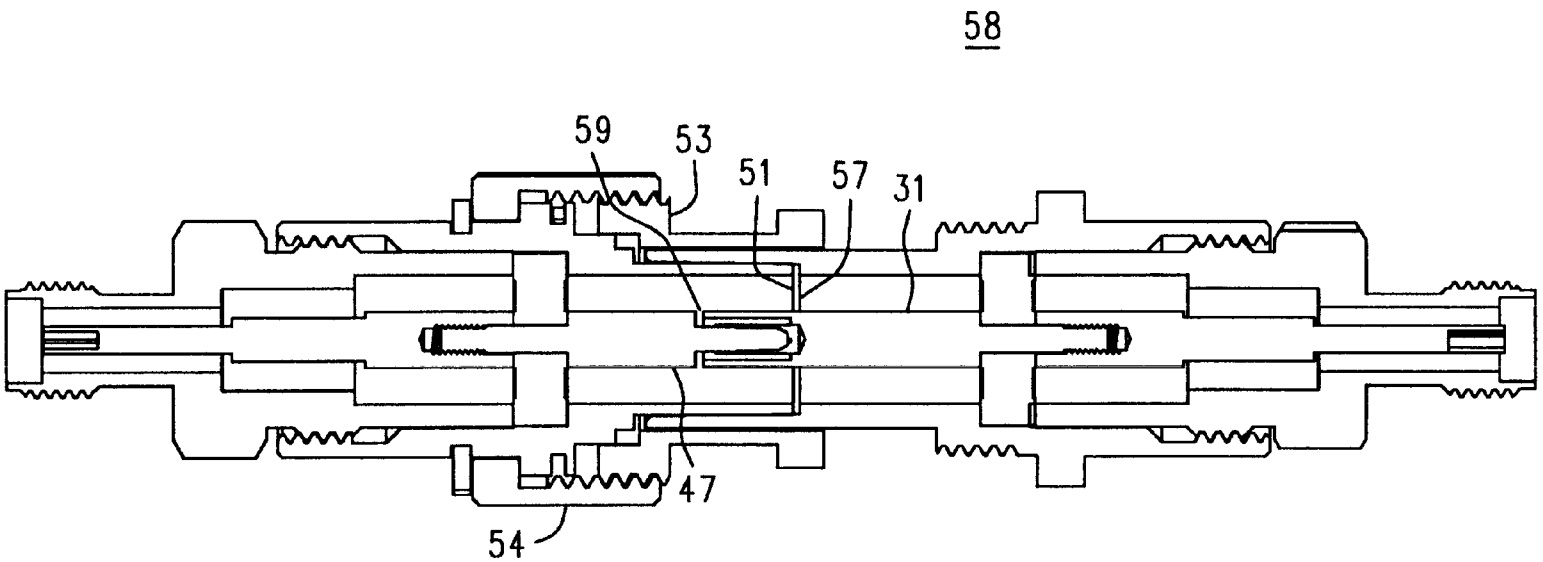
FIG. 5 is a cut-away side view of a partially mated pair of the precision BNC male and female connector halves of FIG. 3.

Refer now to FIG. 5, which is a cross sectional view 58 similar to that of FIG. 4, except that the connector halves are partially mated. Note how annular surface 51 has approached surface 57, while at the same time male center pin 47 has penetrated female center pin 31. The gap between annular surface 51 and surface 57 equals the gap 59 between the two center pins 47 and 31. (In connection with these gaps, it will be noticed that there is a little bit of thread 53 that is not yet drawn beneath the knurled draw nut 46.) These gaps will vanish at the same time, and yet share the compressive force provided by the knurled draw nut 46. This is important for minimizing the visibility to high frequency RF of the physical joint between the connectors.

Figure 6:
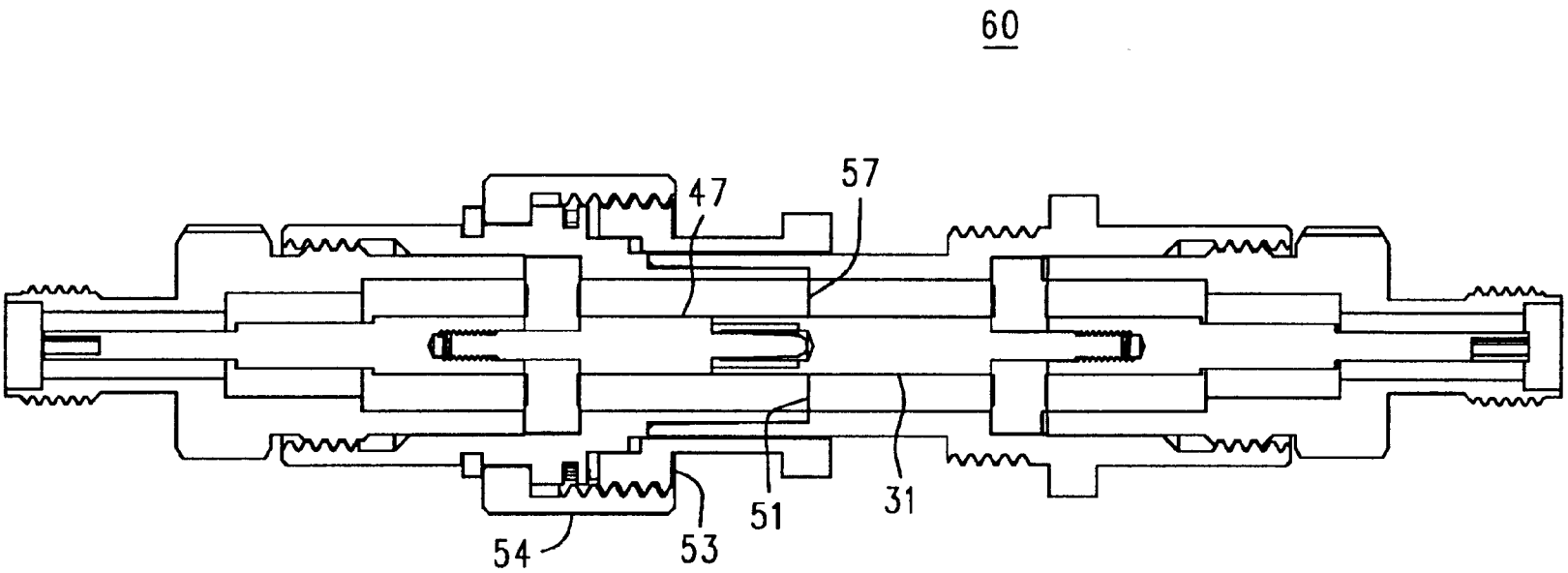
FIG. 6 is a cut-away side view of a fully mated pair of the precision BNC male and female connector halves of FIG. 3.

Finally, refer now to FIG. 6. It is a cross section view 60 similar to that 58 of FIG. 5. The difference is that mating has been fully accomplished, and the draw nut tightened. Notice that there is no longer any gap between the surfaces 51 and 57, and that gap 59 is gone. Note also that all of threads 53 are now within draw nut 46, which is in keeping with the fact that it is the displacement of the draw nut 46 on threads 53 that provides the force that holds the connector halves rigidly together once the pins 29 have engaged the detent 38.

(Unfortunately, those pins and the detent are not visible in the cut-away views of FIGS. 4, 5 and 6.)

I claim:

1. A female BNC connector half comprising:

a female BNC connector shell with bayonet pins proximate one end and having a shouldered bore therethrough;

center conductor support bead having a central hole therein and that fits snugly in the shouldered bore and rests against a shoulder therein when inserted into the shouldered bore from an end opposite the location of the bayonet pins;

a threaded retaining member that screws into the shouldered bore at the end opposite the locations of the bayonet pins and that contacts the center conductor support bead and holds it against the shoulder;

a female center conductor pin held coaxially along the axis of the shouldered bore by threaded compression through the central hole in the center conductor support bead and which forms an air dielectric transmission line with the shouldered bore; and a connecting center conductor passing coaxially through a bore in-the threaded retaining member, which threadably mates with the female center conductor pin through the central hole in the center conductor support bead to provide the above recited threaded compression, and that is part of a transmission line for carrying signals to and from the female BNC connector half.

2. A female BNC connector half as in claim 1, wherein the threaded retaining member comprises a female APC 3.5 connector shell and the connecting center conductor comprises an APC 3.5 female center conductor pin.

3. A female BNC connector half as in claim 1, wherein the threaded retaining member comprises a clamp type cable attachment.

4. A female BNC connector half as in claim 1, wherein the threaded retaining member comprises a connector shell of another series of RF connectors, and the connecting center conductor comprises a center conductor pin belonging to that other series.

* * * * *